US006619631B2

(12) United States Patent
Painter

(10) Patent No.: US 6,619,631 B2
(45) Date of Patent: Sep. 16, 2003

(54) MODULAR FENCE PANEL FENCE CAP

(76) Inventor: Rex E. Painter, 1809 E. Sherman Ave., Nampa, ID (US) 83686

( * ) Notice: Subject to any disclaimer, the term of this patent is extended or adjusted under 35 U.S.C. 154(b) by 0 days.

(21) Appl. No.: 09/863,553

(22) Filed: May 22, 2001

(65) Prior Publication Data

US 2001/0048103 A1 Dec. 6, 2001

Related U.S. Application Data

(60) Provisional application No. 60/206,594, filed on May 23, 2000.

(51) Int. Cl.[7] ..... H01L 29/04

(52) U.S. Cl. ..... 256/65.01; 256/65; 256/67; 256/247

(58) Field of Search ..... 256/65, 65.01, 256/67, 68, 69, 247, 1; 403/286, 169, 172; 24/339

(56) References Cited

U.S. PATENT DOCUMENTS 1,237,837 A * 8/1917 Sundh ..... 256/1
2,508,110 A 5/1950 Hansen
4,122,631 A * 10/1978 Batcheller ..... 49/386
4,136,985 A * 1/1979 Taul ..... 403/172
4,523,745 A 6/1985 Killman et al.
4,710,049 A 12/1987 Chang
4,789,138 A 12/1988 Acton
4,930,753 A 6/1990 Alvyn
5,058,863 A 10/1991 Maffet
5,240,230 A * 8/1993 Dougherty ..... 256/24
5,291,708 A * 3/1994 Johnson ..... 256/24
5,328,156 A 7/1994 Hoke
5,362,030 A 11/1994 Iler, Jr. et al.
5,577,710 A * 11/1996 Kirby ..... 256/11
5,794,390 A 8/1998 Oliveri et al.
5,957,436 A 9/1999 Ristau
6,305,672 B1 * 10/2001 Case et al. ..... 256/65.01

* cited by examiner

*Primary Examiner*—Lynne H. Browne
*Assistant Examiner*—Aaron M Dunwoody
(74) *Attorney, Agent, or Firm*—Joseph W. Holland

(57) ABSTRACT

A fence cap and a fence cap system for bridging a gap between a corner of a first fence panel and a corner of an attached second fence panel by bridging and forming a closure over a gap between a corner of a first fence panel and a corner of an attached second fence panel.

13 Claims, 10 Drawing Sheets

MODULAR FENCE PANEL FENCE CAP

This application claims the benefit of U.S. Provisional Application No. 60/206,594, filed May 23, 2000.

TECHNICAL FIELD

The present invention relates generally to fencing and more particularly to a fence cap to be employed with modular fencing panels.

BACKGROUND

Modular fencing panels are employed for a variety of applications including the construction of livestock fencing, penning and livestock chutes. Modular fencing panels are commonly configured including a top rail, a bottom rail and a pair of side rails, assembled to form the modular fence outer frame. The top rail commonly attaches to the side rail at a radiused corner section. Modular fencing panels may also include one or more horizontal rails connected between the pair of side rails. Modular fence panels are commonly manufactured including one or more hinge connector elements attached along the pair of side rails to permit linked connection of one modular fence panel to another to form a variety of fencing arrangements. The hinged connector elements permit articulation between panels to permit panels to be arranged at various angles to one another. The result is a highly adaptable fencing system that permits setup in an extremely broad range of geometric configurations.

When the modular fence panels are connected sequentially, a gap forms between the side rails of the panels due in part to the offset created by the hinged connector elements. The gap may include a tapered or narrowing configuration created by adjacent radiused sections connecting the side rail to the top rail. The resulting gap creates a potential for hazard to livestock and persons working in the vicinity of the assembled modular fence panels. The hazard involves the potential for catching and trapping an appendage or neck of livestock or a person in the gap. The potential hazard may be of particular concern due to the tapered configuration of the gap. FIG. 12 is an illustration depicting a hazard which may arise employing modular fence panels according to the prior art.

SUMMARY OF THE INVENTION

The present invention is directed to a fence cap and a fence cap system for bridging and blocking a gap between a corner of a first fence panel and a corner of an attached second fence panel by bridging and forming a closure over the gap between a corner of a first fence panel and a corner of an attached second fence panel or other support structure.

The fence cap of the present invention may be used as an attachment on several different types and brands of manufactured modular fence panels commonly used in constructing livestock pens and corrals. Fence caps may be joined in pairs, rigidly or hingedly, to prevent objects including hooves, legs, heads or other body parts from entering and being wedged and caught in the gap formed where a first modular fence panel attaches to an adjoining modular fence panel. Alternately, the present invention may be configured as a saddle which is configured to fit over the top rails of adjoining modular fence panels, spanning the gap formed where the first modular fence panel attaches to an adjoining modular fence panel.

In one embodiment of the invention, the fence cap includes an internal cavity defined by a pair of side members that connect along an upper edge to a spine and along a substantially vertical hip. In the preferred embodiment of the invention, the first and second side panels join at a generally radiused spine and a generally radiused hip. This configuration results in a cavity that includes a generally radiused internal spine and a generally radiused hip resulting in a contoured fit that approximates, yet is larger than, the radius of the top and side rails of the modular fence panel respectively. The internal radius of the spine and the hip approximate generally, yet are larger than, the external radius of the top and side rails of the modular fence panel allowing the fence cap to be place over the modular fence panel.

The fence cap may also include a retainer member. In one embodiment, the retainer member includes one or more compressively opposing retainer fingers formed on the inner surface fence cap. The retainer fingers are sized and configured to compressively grip at least some portion of the circumference of a modular fence panel top or side rail.

In one embodiment of the invention, the fence cap is configured to be employed on a modular fence panel including rails formed of a tubular material having a circular cross-section. Modular fence panels may be manufactured employing steel tubing having a diameter in the range of 1½" to 1⅞" diameter, although the invention is not intended to be limited by the stated configurations or current manufacturing practices. In one embodiment of the invention, the fence caps are manufactured using a polypropylene plastic or a plastic material having similar elastic qualities to allow the legs of the fence cap to spread to permit the fence cap to fit over a rail and to snap or return under compression to an original configuration to be secured to the rail.

In one embodiment of the invention, the fence cap is configured including a flexing member or hinge element formed along a side edge of the fence cap which allows for articulating connection or attachment of a first fence cap to an adjacent fence cap. This feature of the invention permits the fence caps to be employed with the modular fence panels with the panels arranged and connected to include angles. In one embodiment of the invention, a pair of fence caps are connected one to another at corresponding hinge elements. A pin pivotally attaches the corresponding hinge elements.

Fence caps manufactured in accordance with the present invention may also be used on modular gates. Fence caps may be secured to the modular fence panels employing zip ties, pins or screws as securing members.

DETAILED DESCRIPTION

Figure 1:
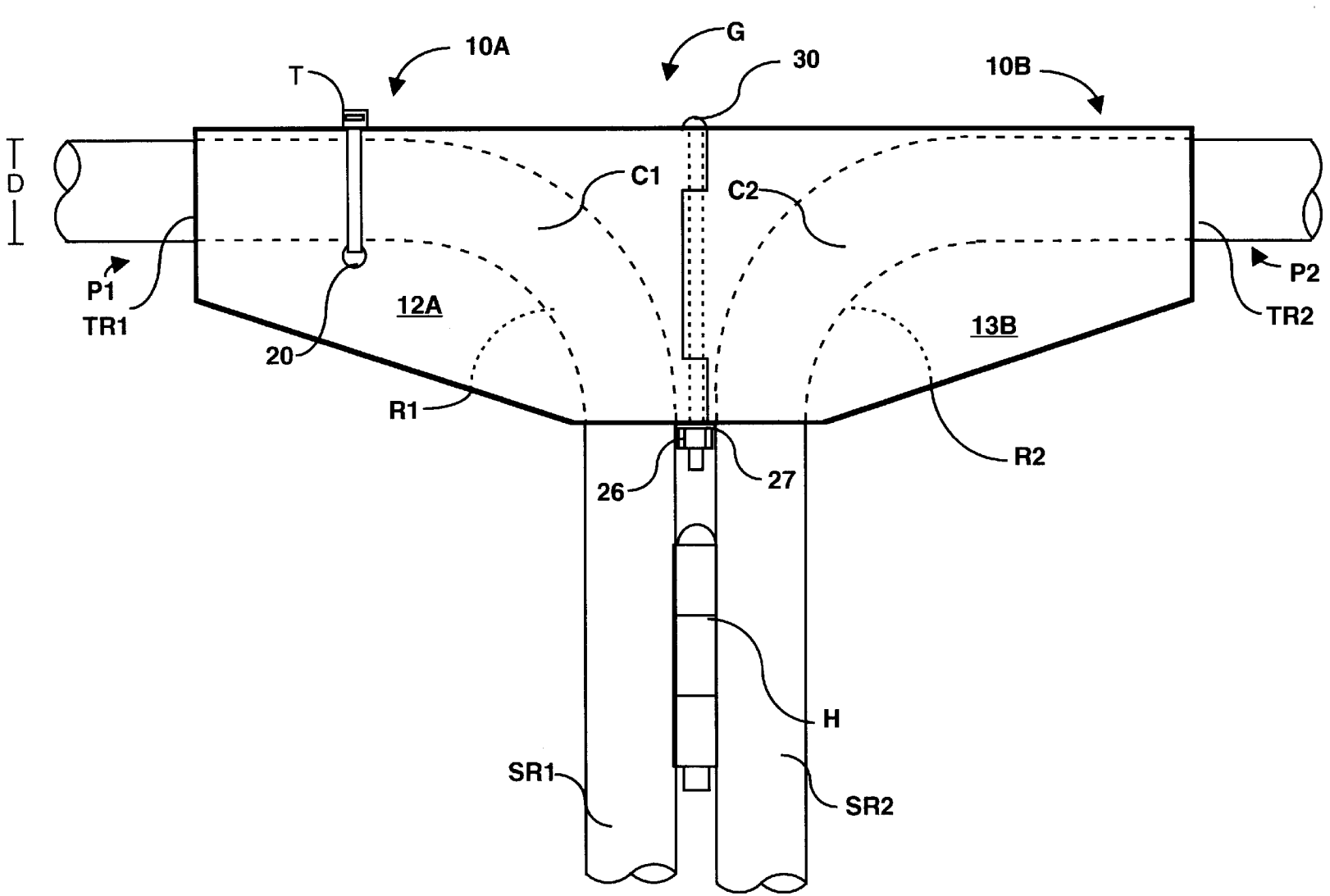
FIG. 1 is a representational side view of a pair of fence caps according to the present invention.
Figures 2, 3A, 3B, 4:
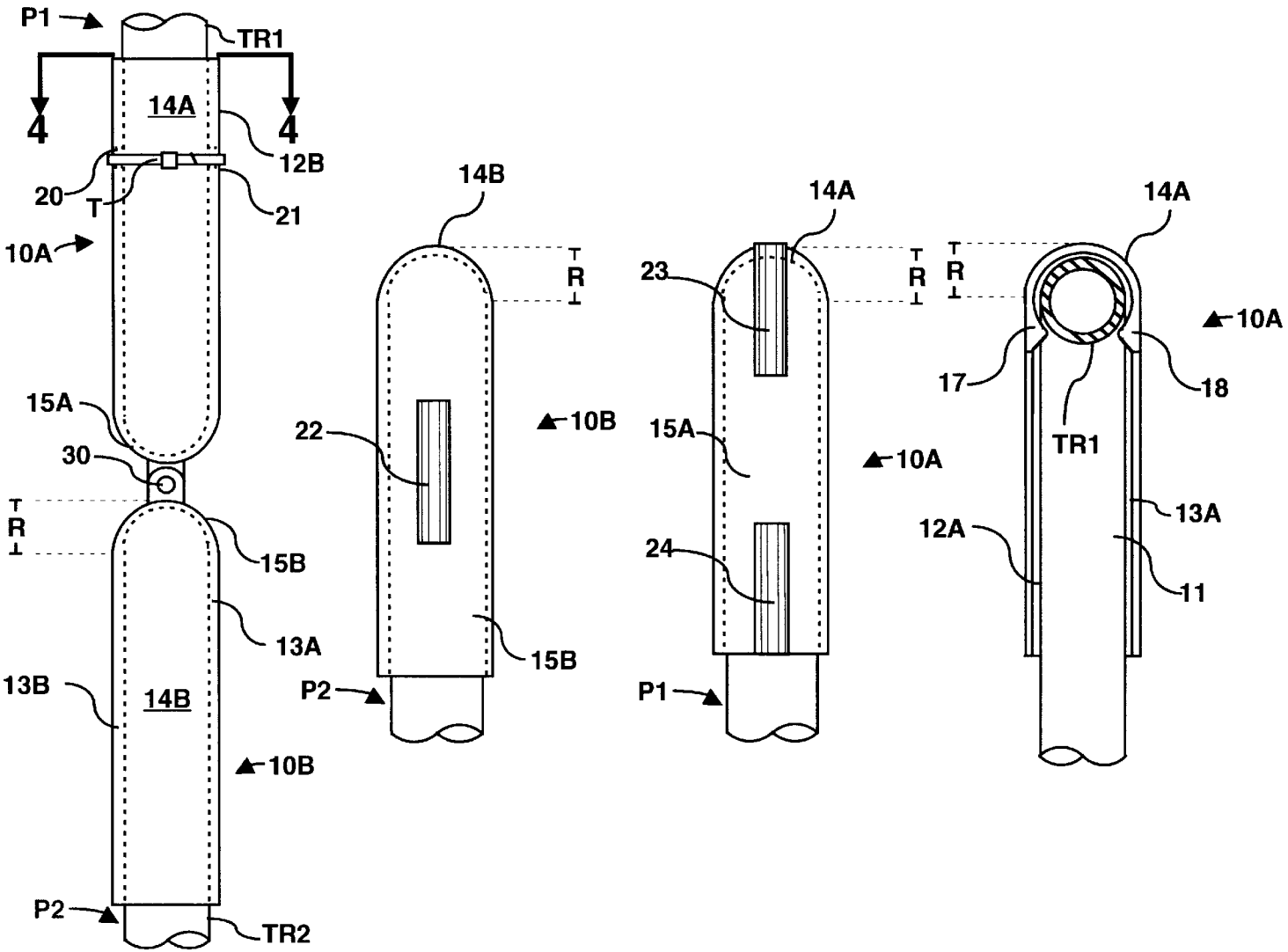
FIG. 2 is a representational top view of a pair of fence caps according to the present invention.
FIG. 3A is a representational first end view of a fence cap including a first hinge element according to the present invention.
FIG. 3B is a representational first end view of a fence cap including second and third hinge elements according to the present invention.
FIG. 4 is a representational second end cutaway view of a fence cap according to the present invention.
Figure 6:
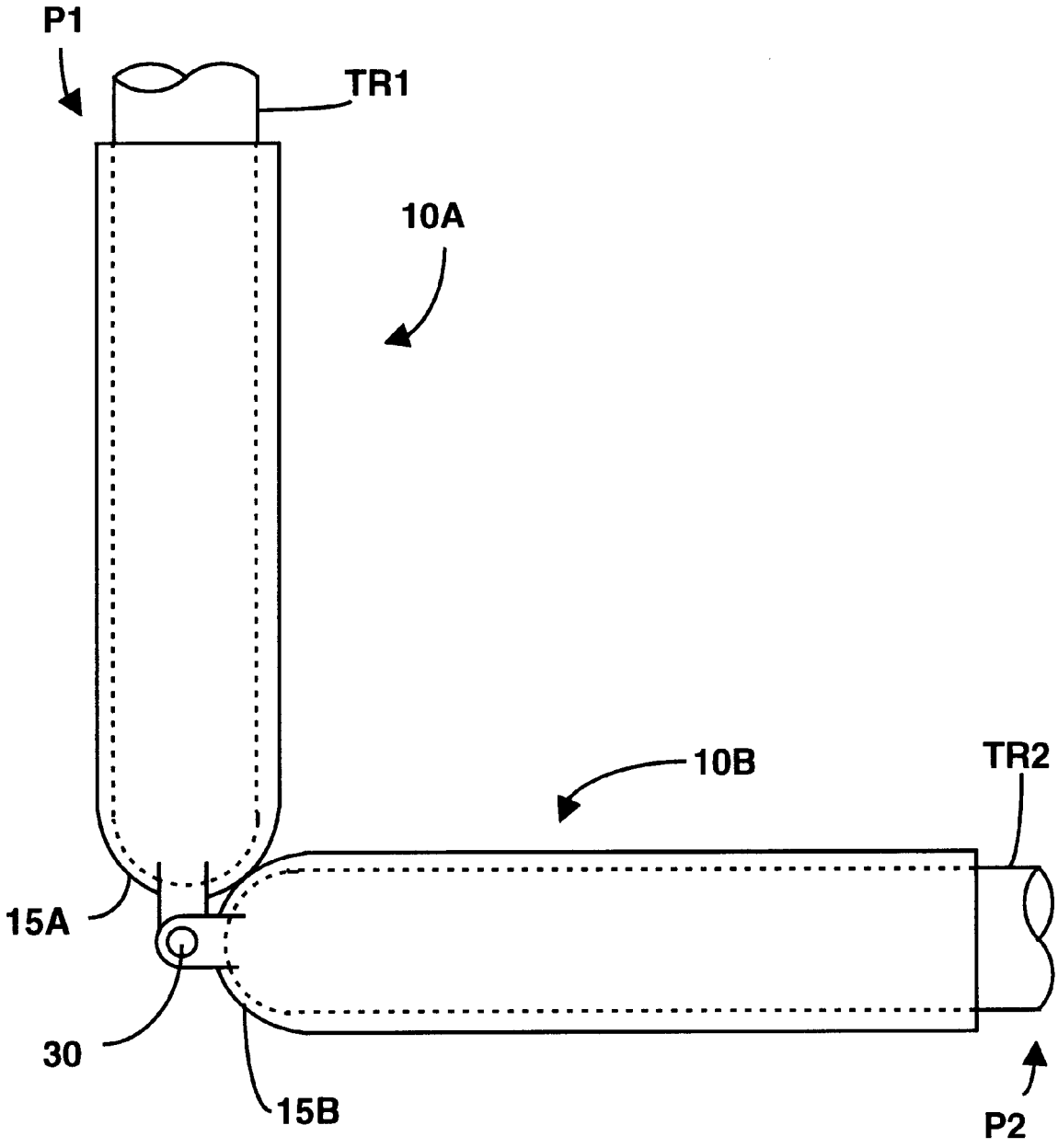
FIG. 6 is a representational top view of a pair of fence caps being employed at a two panel intersection according to the present invention.

FIGS. 1, 2 and 6 show first fence cap 10A and a second fence cap 10B hingedly connected by a hinge pin, in this case, carriage bolt 30.

FIG. 1 shows modular fence panel P1 hingedly connected to modular fence panel P2 at hinge H. Modular fence panel P1 includes top rail TR1 which transitions to side rail SR1 at radiused corner C1. Similarly, modular fence panel P2 includes top rail TR2 which transitions to side rail SR2 at radiused corner C2. Modular fence panels P1 and P2 are manufactured in this case from steel tubing having a tube diameter D. Gap G is formed between the attached modular fence panel P1 and modular fence panel P2.

FIG. 1 shows first fence cap 10A positioned over radiused corner R1 of modular fence panel P1 and second fence cap 10B positioned over the radiused corner R2 of modular fence panel P2. First fence cap 10A and second fence cap 10B are hingedly connected by carriage bolt 30 which is secured from removal by washer 26 and nut 27. FIG. 1 also shows to advantage first side panel 12A of first fence cap 10A and second side panel 13B of second fence cap 10B. Tie T is passed through aperture 20 of first side panel 12A and aperture 21 formed in the opposing second side panel 12B, (shown in FIG. 2) to secure first fence cap 10A to top rail TR1.

FIG. 2 is a representational top view of first fence cap 10A and second fence cap 10B hingedly connected by bolt 30 and positioned over modular fence panel P1 top rail TR1 and modular fence panel P2 top rail TR2 respectively. FIG. 2 shows generally radiused hip 15A of first fence cap 10A and generally radiused hip 15B of second fence cap 10B. The radius R of radiused hip 15A and radiused second end 15B approximates, yet is larger than, the radius of the side rail of modular fence panels P1 and P2. FIG. 2 also shows spine 14A of first fence cap 10A and spine 14B of second fence cap 10B.

FIG. 3A shows second fence cap 10B positioned over modular fence panel P2 and including first cooperating hinge element 22. FIG. 3A also shows generally radiused spine 14B of second fence cap 10B. The radius R of spine 14B approximates, yet is larger than, the radius of the top rail of modular fence panel P2.

FIG. 3B shows fence cap 10A positioned over modular fence panel P1 and including second cooperating hinge element 23 and third cooperating hinge element 24. FIG. 3B also shows generally radiused spine 14A of second fence cap 10A. The radius R of spine 14A approximates, yet is larger than, the radius of the top rail of modular fence panel P1.

FIG. 4 is a cutaway view of fence cap 10A positioned over top rail TR1. Cavity 11 is formed in the area within first side panel 12A, second side panel 13A and generally radiused spine 14A of first fence cap 10A. Fence rail gripping member includes first gripping finger 17 formed at the second end of first side panel 12A and second gripping finger 18, formed at the second end of second side panel 13A.

Figure 5:
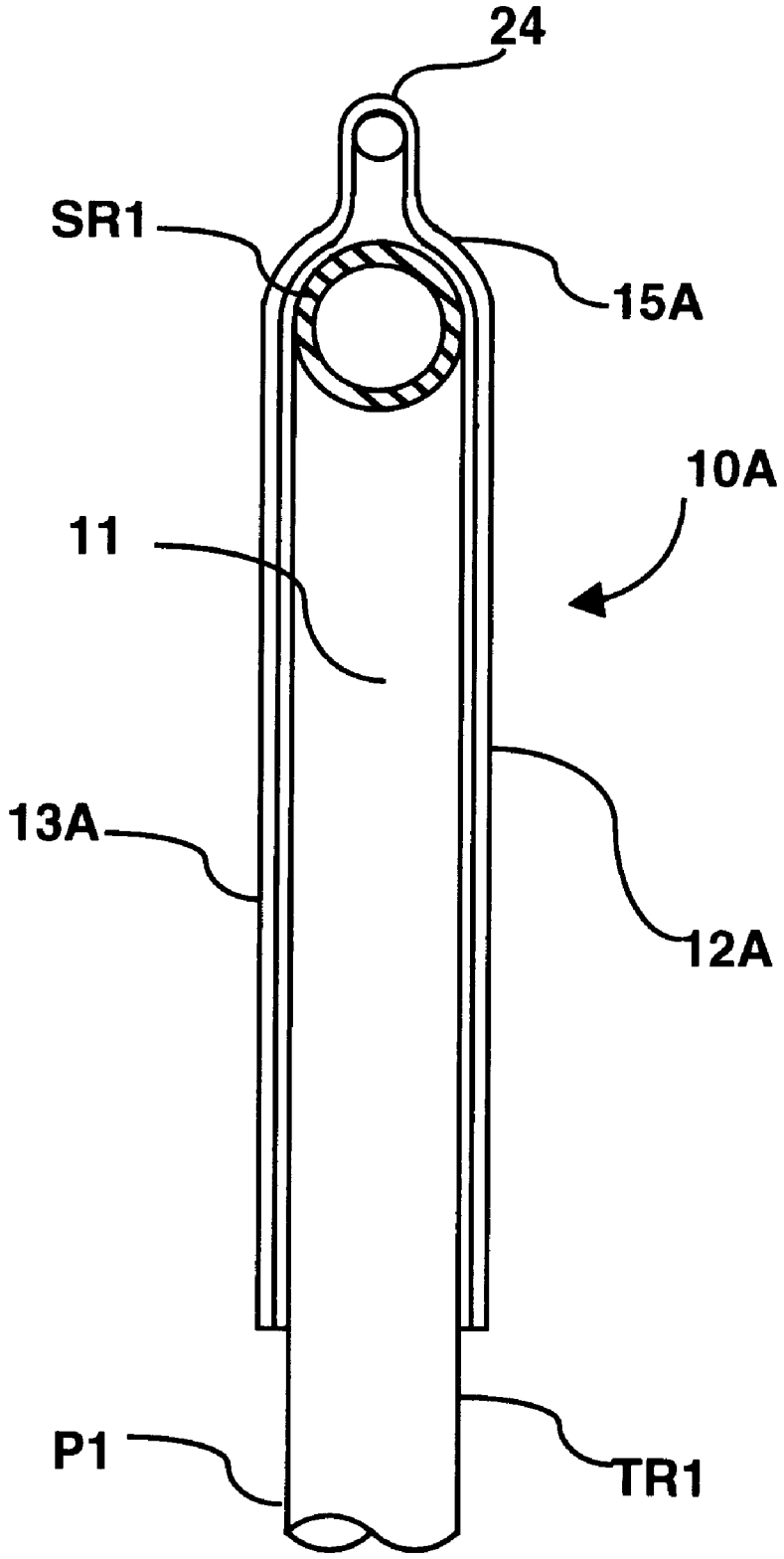
FIG. 5 is a representational top view of a fence cap according to the present invention.

FIG. 5 is a bottom view of fence cap 10A positioned over top rail TR1 and side rail SR1 of modular fence panel P1. Cavity 11 is formed in the area between first side panel 12A, second side panel 13A and generally radiused hip 15A of first fence cap 10A. Hip 15A is shown including third cooperating hinge element 24.

FIG. 6 shows first fence cap 10A and second fence cap 10B hingedly connected by carriage bolt 30 at an intersection of first modular fence panel P1 and second modular fence panel P2. First fence cap 10A is positioned over top rail TR1 of modular fence panel P1 and second fence cap 10B is positioned over top rail TR2 of modular fence panel P2.

Figure 7:
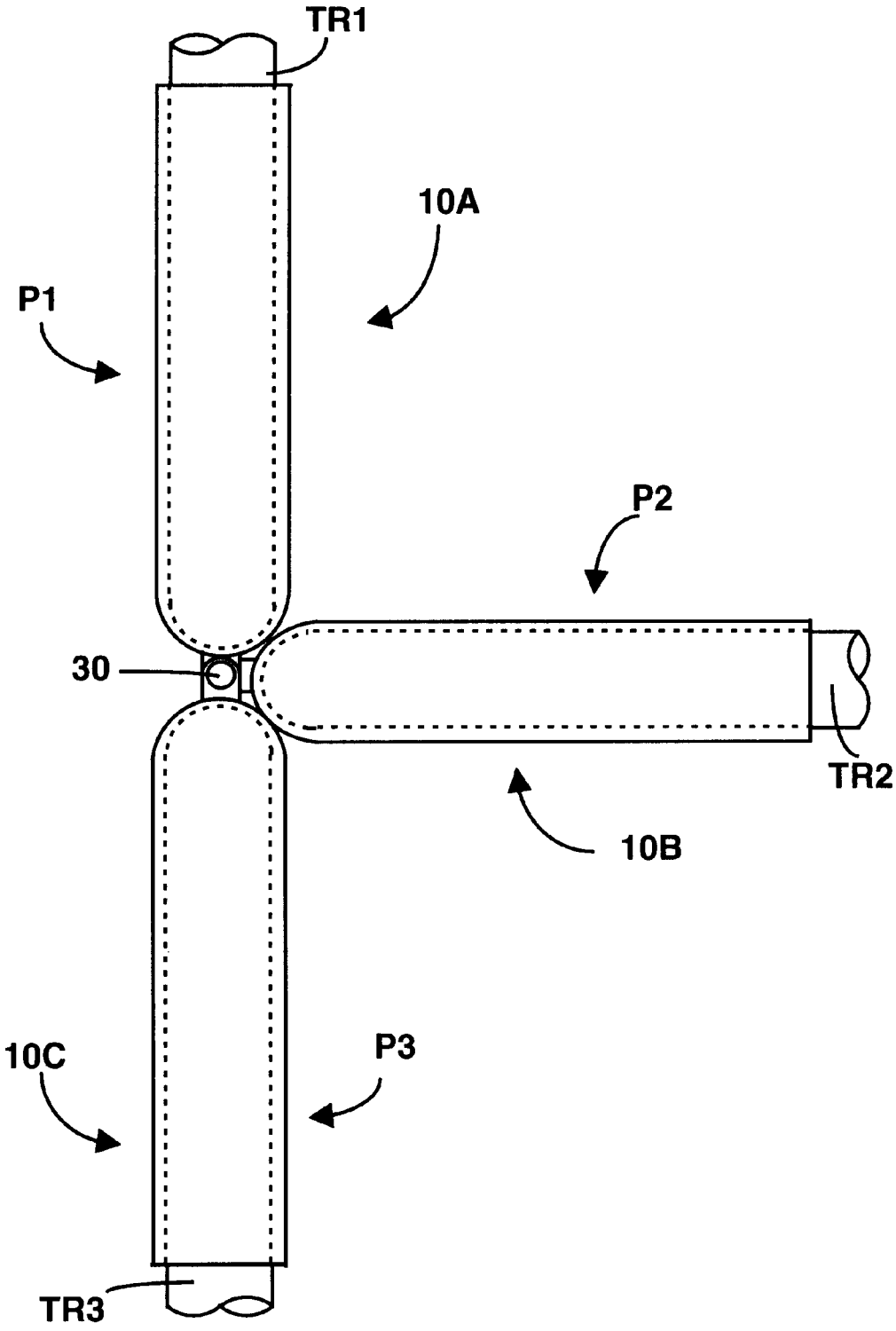
FIG. 7 is a representational top view of three fence caps being employed at a three panel intersection according to the present invention.

FIG. 7 shows first fence cap 10A, second fence cap 10B and third fence cap 10C hingedly connected by carriage bolt 30 at an intersection of first modular fence panel P1, second modular fence panel P2 and third modular fence panel P3. First fence cap 10A is positioned over top rail TR1 of modular fence panel P1, second fence cap 10B is positioned overtop rail TR2 of modular fence panel P2 and third fence cap 10C is positioned over top rail TR3 of modular fence panel P3.

Figure 8:
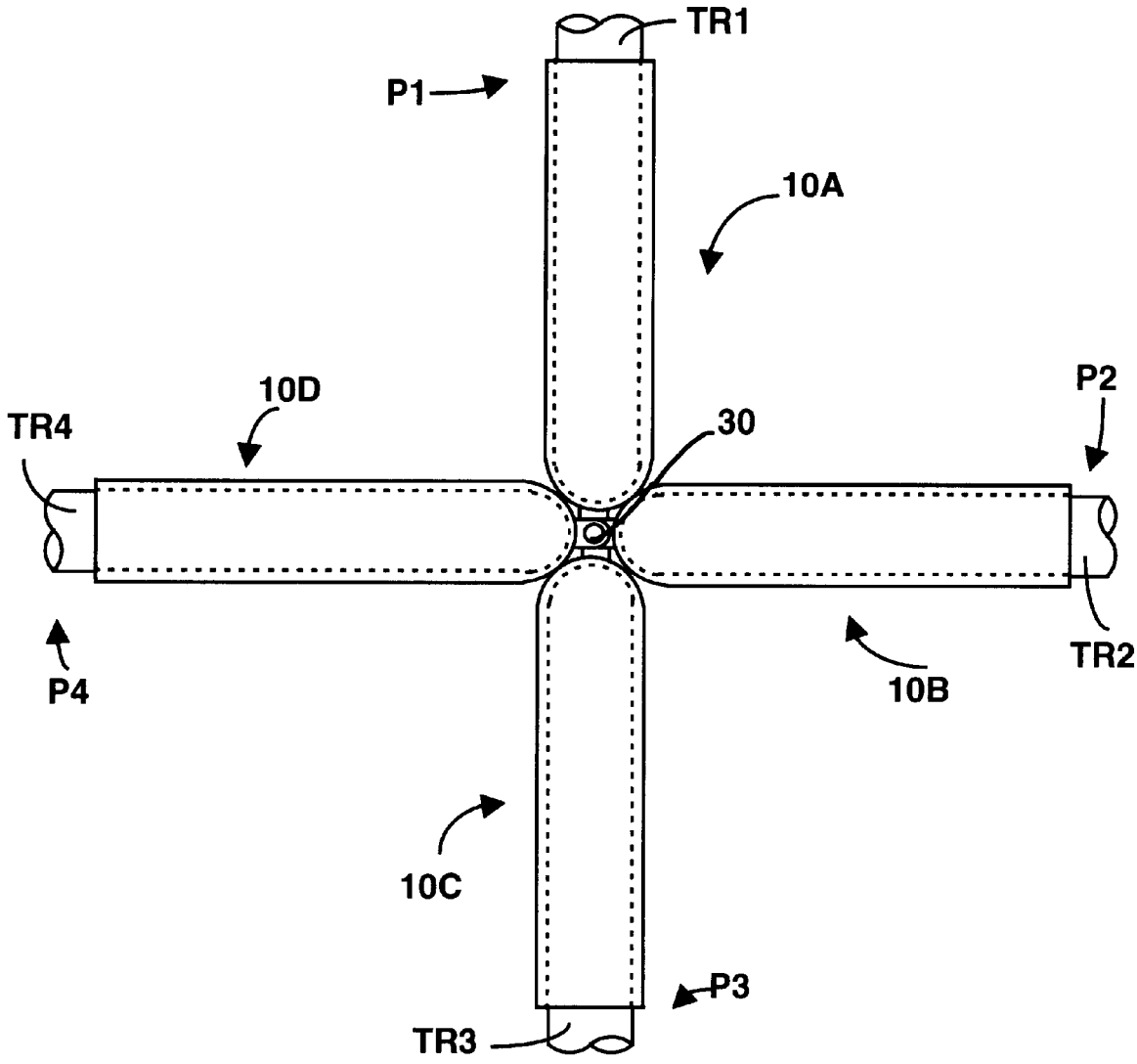
FIG. 8 is a representational top view of four fence caps being employed at a four panel intersection according to the present invention.

FIG. 8 shows first fence cap 10A, second fence cap 10B, third fence cap 10C and fourth fence cap 10D hingedly connected by carriage bolt 30 at an intersection of first modular fence panel P1, second modular fence panel P2, third modular fence panel P3 and fourth modular fence panel P4. First fence cap 10A is positioned overtop rail TR1 of modular fence panel P1, second fence cap 10B is positioned over top rail TR2 of modular fence panel P2, third fence cap 10C is positioned over top rail TR3 of modular fence panel P3 and fourth fence cap 10D is positioned over top rail TR4 of modular fence panel P4.

Figure 9:
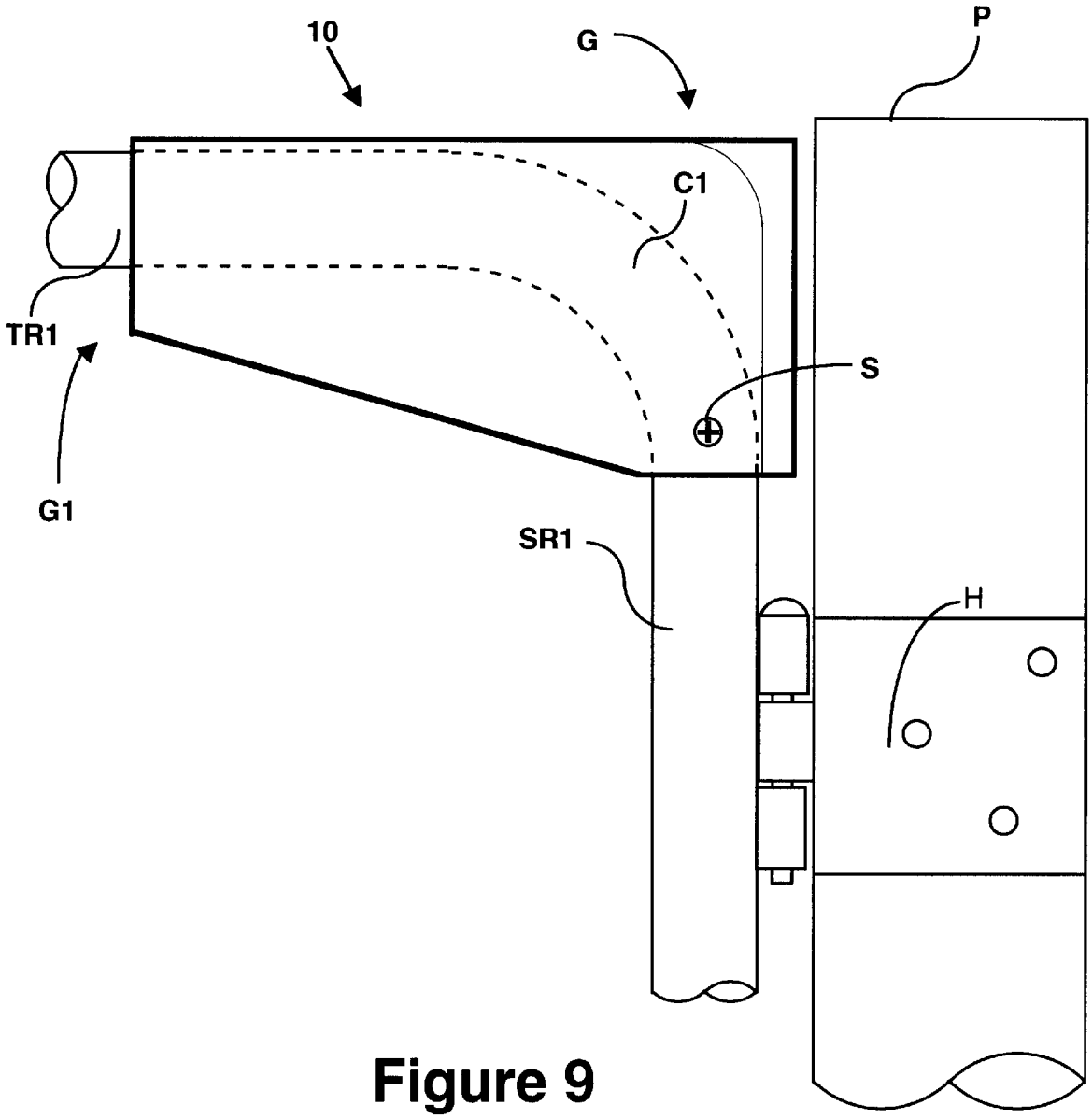
FIG. 9 is a representational side view of a fence cap according to the present invention.

FIG. 9 shows fence cap 10 placed over a corner of modular gate panel G1. Modular gate panel G1 includes top rail TR1 which is joined or transitions to side rail SR1 at radiused corner C1. Fence cap 10 is hingedly connected to post P by at hinge H. Fence cap 10 is connected to modular gate panel G1 by self tapping screw S which is shown screwed through fence cap 10 into side rail SR1. Gap G is formed between the attached modular gate panel G1 and post P.

Figure 10:
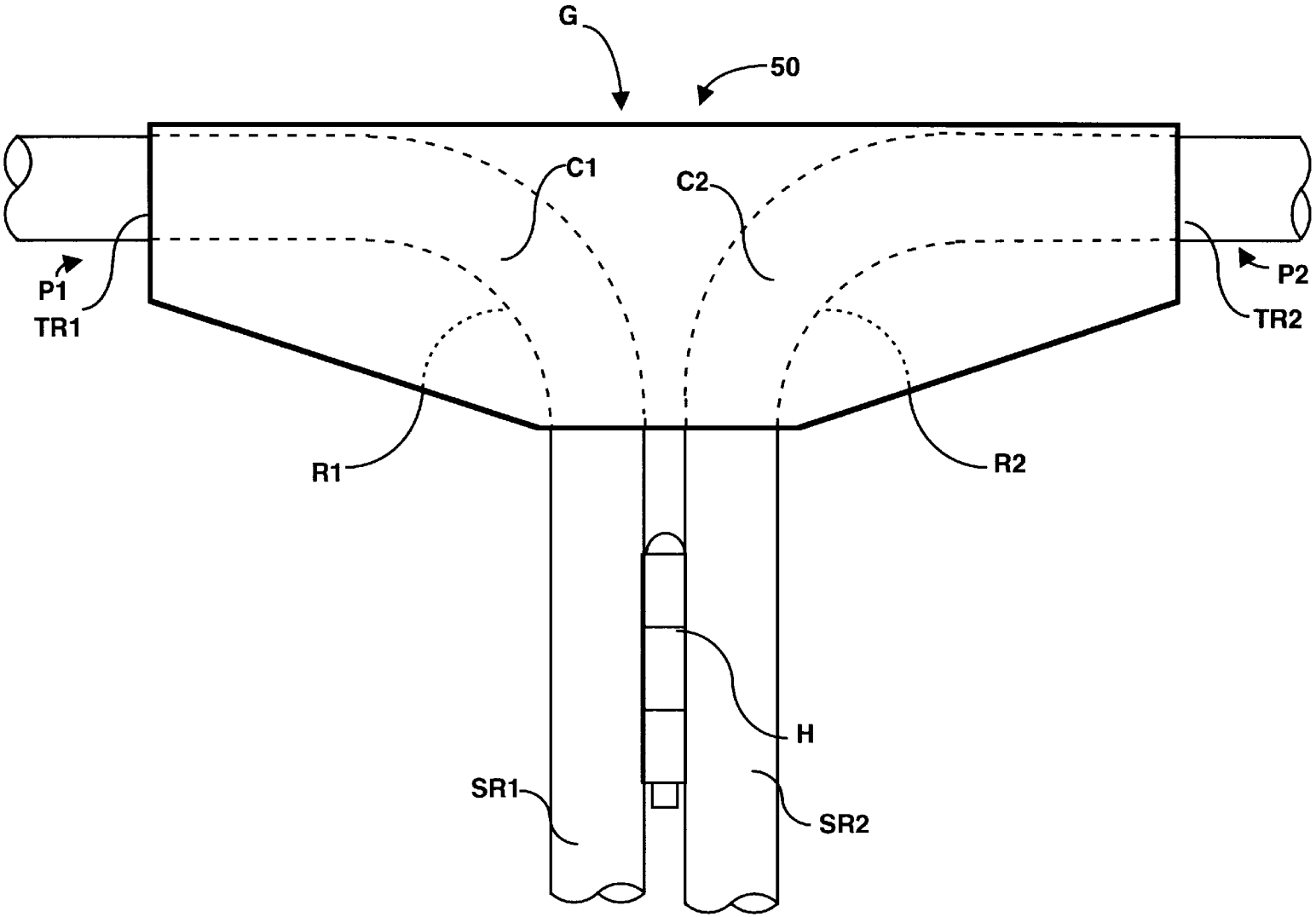
FIG. 10 is a representational view of a saddle fence cap employed between two modular fence panels according to the present invention.

FIG. 10 shows an alternate embodiment of the present invention that is configured as saddle fence cap 50 configured to fit over top rail TR1 of modular fence panel P1, and top rail TR2 of modular fence panel P2. Modular fence panel P1 includes top rail TR1 which transitions to side rail SR1 at radiused corner C1. Similarly, modular fence panel P2 includes top rail TR2 which transitions to side rail SR2 at radiused corner C2. Gap G is formed between the attached modular fence panel P1 and modular fence panel P2. Saddle fence cap 50 spans and covers gap G formed between the attached fence panels P1 and P2. This embodiment may be manufactured to accommodate straight-run fencing or it may be manufactured in pre-selected angular configurations i.e. 90°, 135°, 180° and so forth, depending on the desired configuration of the modular fence panels.

Figure 11:
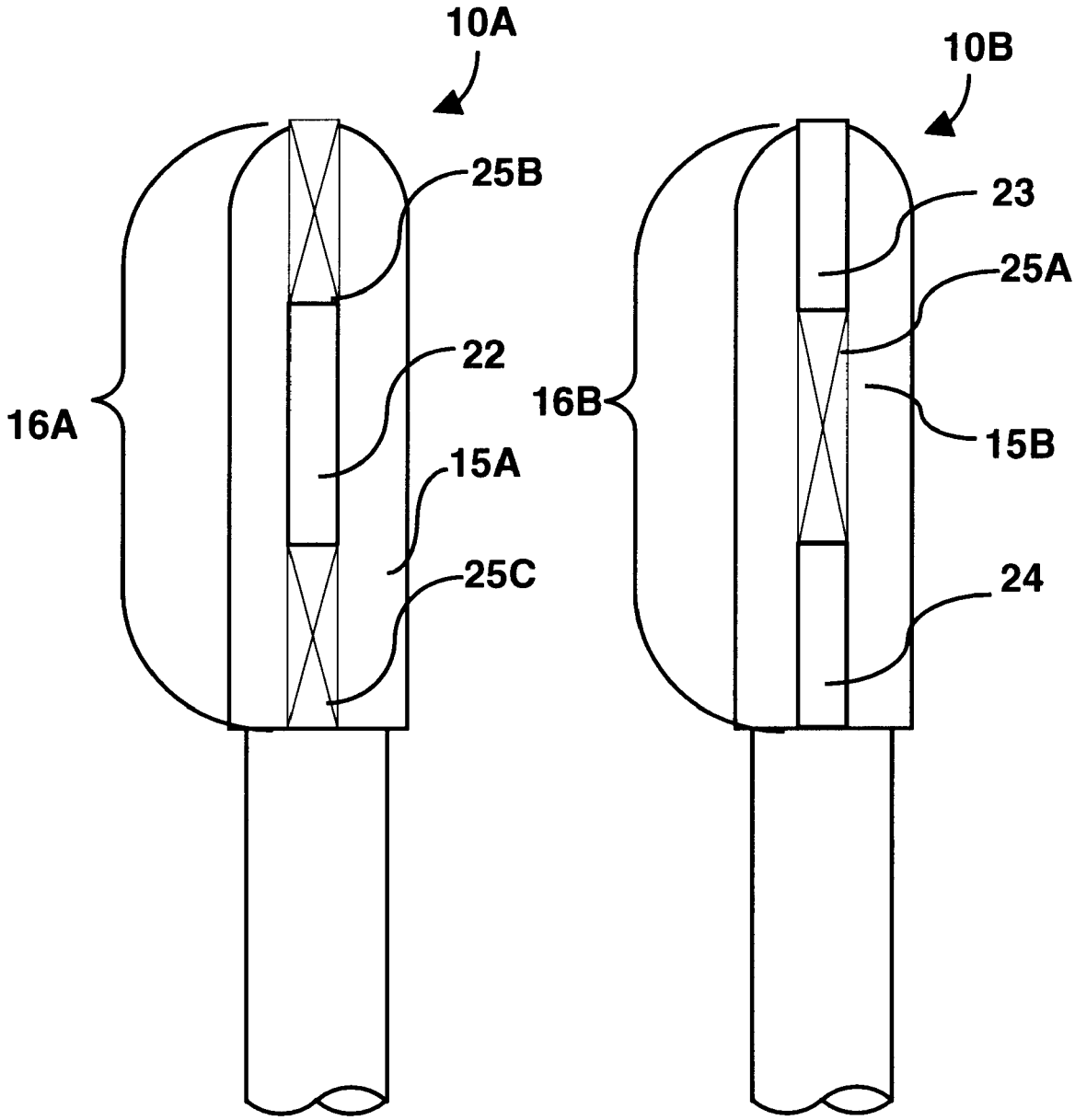
FIG. 11 is a representational first end view of a pair of fence caps showing a pattern for cutting hinge elements.
Figure 12:
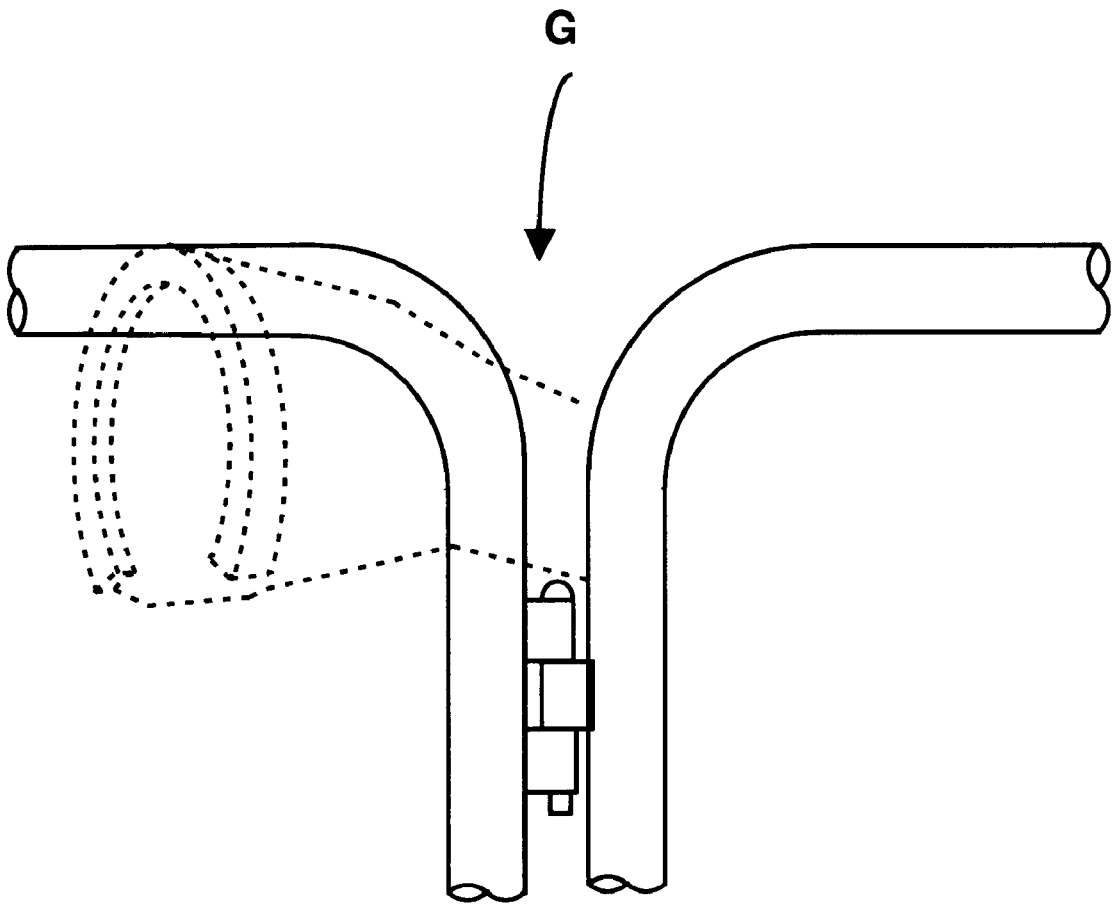
PRIOR ART Figure 12
FIG. 12 is a representational perspective view of a pair of modular fence panels illustrating a potential hazard according to the prior art.

FIG. 11 shows generally radiused hip 15A of first fence cap 10A and generally radiused hip 15B of second fence cap 10B. In one embodiment of the invention, first fence cap 10A and second fence cap 10B are formed by a plastic molding process. In the molding process, ridge 16 is formed and initially is configured such that it is substantially the same length as the end of the fence cap. In a second process sections of ridge 16 are removed by a machine process to form corresponding hinge elements. Section 25A is removed forming in effect second cooperating hinge element 23 and third cooperating hinge element 24. Similarly, section 25B and section 25C are removed forming in effect first cooperating hinge element 22. Alternately, first cooperating hinge element 22, second cooperating hinge element 23 and third cooperating hinge element 24 may be formed as a direct product of the molding process.

While this invention has been described with reference to the detailed embodiments, this is not meant to be construed in a limiting sense. It is contemplated that the appended claims will cover the various modifications to the described embodiments, as well as additional embodiments of the invention as fall within the true scope of the invention.

What is claimed is:

1. A fence cap for forming a substantially right angle corner at a corner of a fence panel including a top rail and a side rail, said fence cap comprising:

a spine;

a first side element attached to and extending from the spine;

a second side element attached to and extending from the spine, the second side element generally opposing the first side element forming an internal cavity configured to be positioned over the top rail of the fence panel;

a retaining member including a fence rail gripping member formed between the generally opposing first side element and second side element; and a hip attached to and extending from the spine at substantially a right angle, the hip configured to be positioned about a portion of the side rail of the fence panel, the hip further including a generally radiused internal surface, for allowing a contoured fit about a side rail of the fence panel.

2. The fence cap of claim 1 wherein the spine further comprises a generally radiused internal surface, for allowing a contoured fit over a top rail of the fence panel.

3. The fence cap of claim 1 wherein the fence rail gripping member further comprises a pair compressively opposing retainer fingers formed between the generally opposing first side element and second side element.

4. The fence cap of claim 1 further comprising a cooperating flexing member formed on the hip of the fence cap for articulated attachment to a second fence cap.

5. The fence cap of claim 4 wherein the cooperating flexing member further comprises a first hinge element for articulated attachment to a second hinge element formed on a second fence cap.

6. A fence cap system for bridging a gap between a corner of a first fence panel and a corner of an attached second fence panel, said fence cap comprising:

a first fence cap including a spine, a first side element attached to and extending from the spine an a second side element attached to and extending from the spine, the second side element generally opposing the first side element forming an internal cavity configured to be positioned over a top rail of the first fence panel for forming a substantially right angle corner of the first fence panel;

a second fence cap including a hip attached to and extending from the spine of the second fence cap at substantially a right angle, the hip including a generally radiused internal surface, for allowing a contoured fit about a side rail of the second fence panel, the second fence cap connected to the first fence cap at a flexing member, the second fence cap including a spine, a first side element attached to and extending from the spin and a second side element attached to and extending from the spine, the second side element generally opposing the first side element forming an internal cavity configured to be positioned over a top rail of the second fence panel for forming a substantially right angle corner of the second fence panel; and a fence rail gripping member formed between the generally opposing first side element and second side element.

7. The fence cap system of claim 6 wherein the first fence cap further comprises a hip attached to and extending from the spine at substantially a right angle, the hip configured to be positioned about a side rail of the first fence panel.

8. The fence cap system of claim 6 wherein the spine of the first fence cap further comprises a generally radiused internal surface, for allowing a contoured fit over a top rail of the first fence panel.

9. The fence cap system of claim 6 wherein the spine of the second fence cap further comprises a generally radiused internal surface, for allowing a contoured fit over a top rail of the second fence panel.

10. The fence cap of claim 7 wherein the hip of the first fence cap further comprises a generally radiused internal surface, for allowing a contoured fit about a side rail of the first fence panel.

11. The fence cap of claim 6 wherein the first fence cap further comprises a retaining member for retaining the first fence cap on the first fence panel.

12. The fence cap of claim 6 wherein the second fence cap further comprises a retaining member for retaining the fence cap on the second fence panel.

13. The fence cap of claim 6 wherein the flexing member further comprises a first hinge element for articulated attachment to a second hinge element formed on a second fence cap.

* * * * *